US006739901B2

(12) United States Patent
Maeda

(10) Patent No.: US 6,739,901 B2
(45) Date of Patent: May 25, 2004

(54) CONNECTOR, CONNECTOR ASSEMBLY AND A METHOD OF CONNECTING A CONNECTOR

(75) Inventor: Taisaku Maeda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/631,994

(22) Filed: Jul. 31, 2003

(65) Prior Publication Data

US 2004/0029434 A1 Feb. 12, 2004

(30) Foreign Application Priority Data

Aug. 8, 2002 (JP) ..... 2002-231003

(51) Int. Cl.[7] ..... H01R 3/00
(52) U.S. Cl. ..... 439/488; 439/352
(58) Field of Search ..... 439/488, 489, 439/352, 372

(56) References Cited

U.S. PATENT DOCUMENTS 5,230,635 A * 7/1993 Takenouchi et al. ..... 439/157
5,722,843 A * 3/1998 Kerckhof et al. ..... 439/157
6,109,955 A * 8/2000 Hanazaki et al. ..... 439/489
6,247,957 B1 6/2001 Hasegawa ..... 439/352

* cited by examiner

*Primary Examiner*—Alex Gilman
(74) *Attorney, Agent, or Firm*—Gerald E. Hespos; Anthony J. Casella

(57) ABSTRACT

A female housing (20) can be locked in a receptacle (11) of a male housing (10) by a resiliently displaceable a lock arm (22). A detector (40) is mounted on the female housing (20) and engages the receptacle (11) during connection of the housings (20, 10). The engagement causes the detector (40) to rotate from an initial mount position to a retracted position. The detector (40) can be slid from the retracted position to an advanced position only when the housings (20, 10) are connected properly.

12 Claims, 13 Drawing Sheets

CONNECTOR, CONNECTOR ASSEMBLY AND A METHOD OF CONNECTING A CONNECTOR

BACKGROUND OF THE INVENTION

1. Field of the Invention

The invention relates to a connector, a connector assembly and a method of connecting a connector that has a connection detecting function.

2. Description of the Related Art

U.S. Pat. No. 6,247,957 shows a connector with a detector to detect whether male and female housings are connected properly. This connector has a resiliently deflectable lock arm in the female housing for locking the housings in their connected states. A detector is insertable into an inclination permitting space that permits inclination of the lock arm. The detector normally is before the inclination permitting space and is pushed into the inclination permitting space after the housings are connected.

The lock arm is inclined during connection, but returns to its initial position after the housings are connected for locking the housings together. Therefore, the detector can be pushed into the inclination permitting space. On the other hand, the detector contacts a lock arm that is still in the inclination permitting space, if the housings are connected only partly based on whether the detector can be pushed in. However, a pushing stroke of a detector of a small connector is small. Thus, it is difficult to judge whether the detector still is at a retracted position or has been pushed into the inclination permitting space.

The present invention was developed in view of the above problem and an object thereof is to perform a connection detection with high reliability.

SUMMARY OF THE INVENTION

The invention relates to a connector comprising a housing that is connectable with a mating housing. A resiliently displaceable lock arm is provided at the housing to lock the housings in their properly connected state. A detector is provided to detect whether the housings are connected properly. The detector is movable along a pushing direction between a retracted position where resilient displacement of the lock arm is permitted and an advanced position where resilient displacement of the lock arm is prevented. The detector is rotatable from an initial mount position toward the retracted position and is engageable with an engaging portion of the mating housing to be rotated from the mount position at an intermediate stage of connection of the two housings and to bring the detector to the retracted position when the housings are connected properly.

The housing may have restricting means for preventing the detector from being pushed in the moving direction until reaching the retracted position.

The lock arm is displaced resiliently when the housings are connected with the detector at the mount position. Thus, the engaging portion engages the detector and rotates the detector toward the retracted position. The detector could be pushed at the intermediate stage of the connection. However, the restricting means prevents the detector from being moved and partial connection of the housings is detected. On the other hand, the detector is brought to the retracted position when the housings are connected properly. Locking is effected by the return of the lock arm, and the detector can move to the advanced position. Thus, proper connection of the housings can be detected. Simultaneously, an inadvertent displacement of the lock arm is prevented, to effect double locking.

Proper connection can be detected in two ways, namely, by rotation of the detector from the mount position to the retracted position, or by moving the detector from the retracted position to the advanced position. Further, the construction can be simpler since a single detector makes the two detections.

The housing preferably can fit into a receptacle in the mating housing and the opening edge of the receptacle serves as the engageable portion.

The receptacle of the mating housing rotates the detector from the mount position to the retracted position. Thus, the mating housing is simple as compared to a case where the engaging portion is separate. Further, the rotation of the detector does not change the shape of the mating housing at all.

The detector preferably comprises a restricting portion that is located inside a deformation space for the lock arm when the detector is in the advanced position so as to prevent the resilient displacement of the lock arm.

Rotation preventing means may be provided for preventing rotation of the detector when it is moved between the retracted and advanced positions.

Locks may be provided to lock the detector in the advanced position.

The invention also relates to a connector assembly comprising the above-described connector and a mating connector connectable therewith.

The invention also relates to a method for connecting a connector with a mating connector. The method comprises connecting a housing of the connector with a mating housing of the mating connector, and locking the housing and the mating housing substantially in their properly connected state by a lock arm provided at the housing. The method continues by detecting whether the housings are connected properly by means of a detector movable along a moving direction between a retracted position where resilient displacement of the lock arm is permitted and an advanced position where resilient displacement of the lock arm is prevented. The detector engages an engaging portion of the mating housing and is rotated from the mount position at an intermediate stage of connection of the two housings and is brought to the retracted position when the housings are connected properly.

A restricting means may prevent the detector from being pushed in the moving direction until the detector reaches the retracted position.

The method may comprise fitting the housing into a receptacle in the mating housing so that the edge of the receptacle is the engageable portion.

Rotation of the detector preferably is prevented by rotation preventing means when it is moved between the retracted and advanced positions. The method may comprise locking the detector in the advanced position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 13. The connector has a male housing 10 and a female housing 20 that are connectable with each other along a connecting direction CD.

The male housing 10 is made e.g. of a synthetic resin and includes a receptacle 11 that projects integrally from an outer wall of a piece of equipment. Tab-shaped male terminals (not shown) project from the back surface of the receptacle 11 and are connected with circuitry in the equipment.

The female housing 20 also is made e.g. of a synthetic resin and is substantially in the form of a block. The female housing 20 is fittable into the male housing 10 with left and right surfaces thereof held substantially in sliding contact with corresponding left and right inner surfaces of the receptacle 11. Cavities (not shown) are formed in the female housing 20 in positions corresponding to the male terminals. Female terminals are connected with ends of wires and are inserted into the respective cavities from behind (from the right side in FIG. 1).

Figure 7:
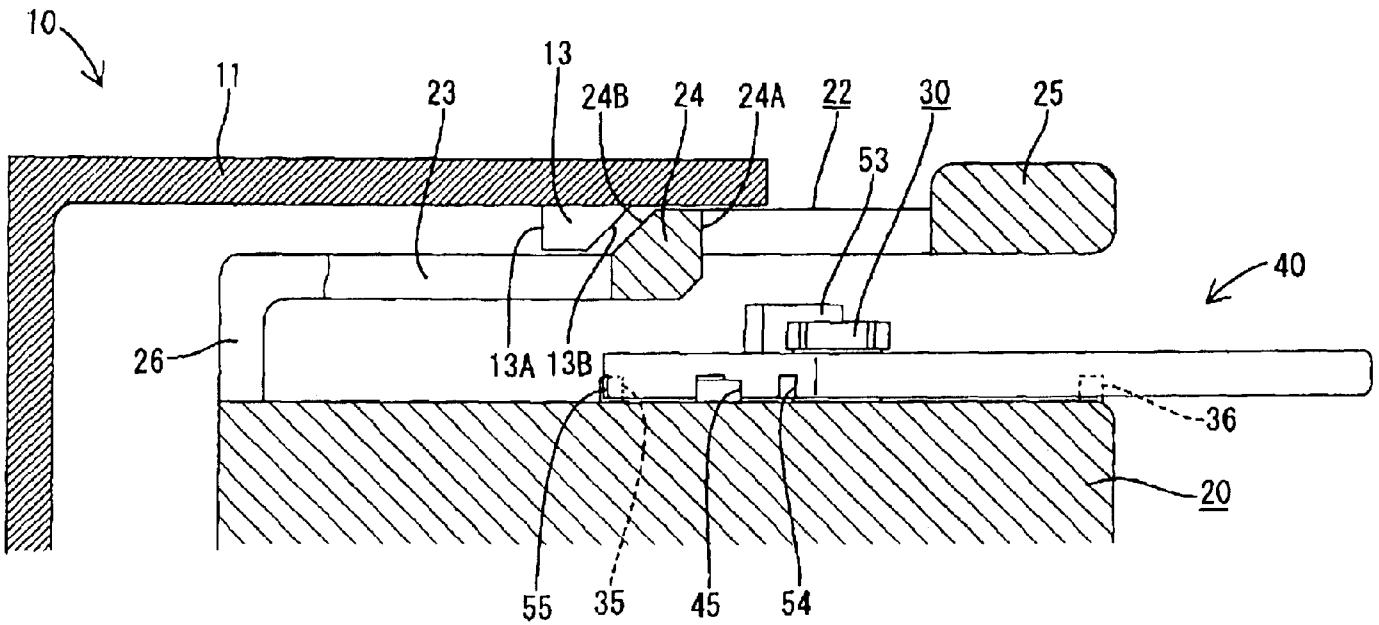
FIG. 7 is a vertical section showing the state of FIG. 6.

A lock arm 22 for locking the female housing 20 and the mating male housing 10 in their properly connected state is formed unitarily on the upper surface of the female housing 20. As shown in FIG. 7, the lock arm 22 projects up from a substantially from a widthwise middle of the front edge of the upper surface of the female housing 20 and extends back along the connecting direction CD. The lock arm 22 has a groove 23 between two forked sections and projects out at an intermediate position to define a stepped shape. The forked sections of the lock arm 22 are coupled at a stepped part to form an engageable portion 24 and at an extending end to form an operable portion 25. The operable portion 25 of the lock arm 22 is inclinable down toward the female housing 20 with the extending-up portion thereof at the front end as a supporting point 26.

The engageable portion 24 of the lock arm 22 includes a rearwardly facing locking surface 24A (right surface in FIG. 7), and an upwardly and forwardly facing guiding surface 24B. On the other hand, a locking projection 13 projects from the ceiling surface of the receptacle 11 of the male housing 10, and has substantially the same width as the groove 23. Thus, the locking projection 13 can contact the engageable portion 24 of the lock arm 22 in a natural state. The locking projection 13 has a rearwardly facing locking surface 13A (left side in FIG. 7) and a forwardly and downwardly facing slanted guiding surface 13B.

The guiding surface 24B of the engageable portion 24 of the lock arm 24 contacts the guiding surface 13B of the locking projection 13 at an intermediate stage of insertion of the female housing 20 into the receptacle 11 of the male housing 10. Thus, the lock arm 22 is inclined resiliently (see FIG. 9). The female housing 20 can be pushed to a proper position where the front surface thereof substantially contacts the back surface of the receptacle 11 of the male housing 10. In this position, the engageable portion 24 passes the locking projection 13 and the lock arm 22 returns. As a result, the locking surface 24A of the engageable portion 24 engages the locking projection 13 from behind as seen in the connecting direction CD (see FIG. 11), and the two housings 10, 20 are locked in their properly connected state.

A detector 40 is mounted on the upper surface of the female housing 20 for detecting the connected state of the two housings 10, 20. The detector 40 is made e.g. of a synthetic resin and is formed into a substantially square in plan view having sides slightly shorter than the width of the female housing 20. Operable projections 41 are provided at substantially opposite ends of one side (upper side in FIG. 1) of the detector 40. Hereinafter, the side where the operable projections 41 are provided is referred to as an operable side 40A.

Figure 1:
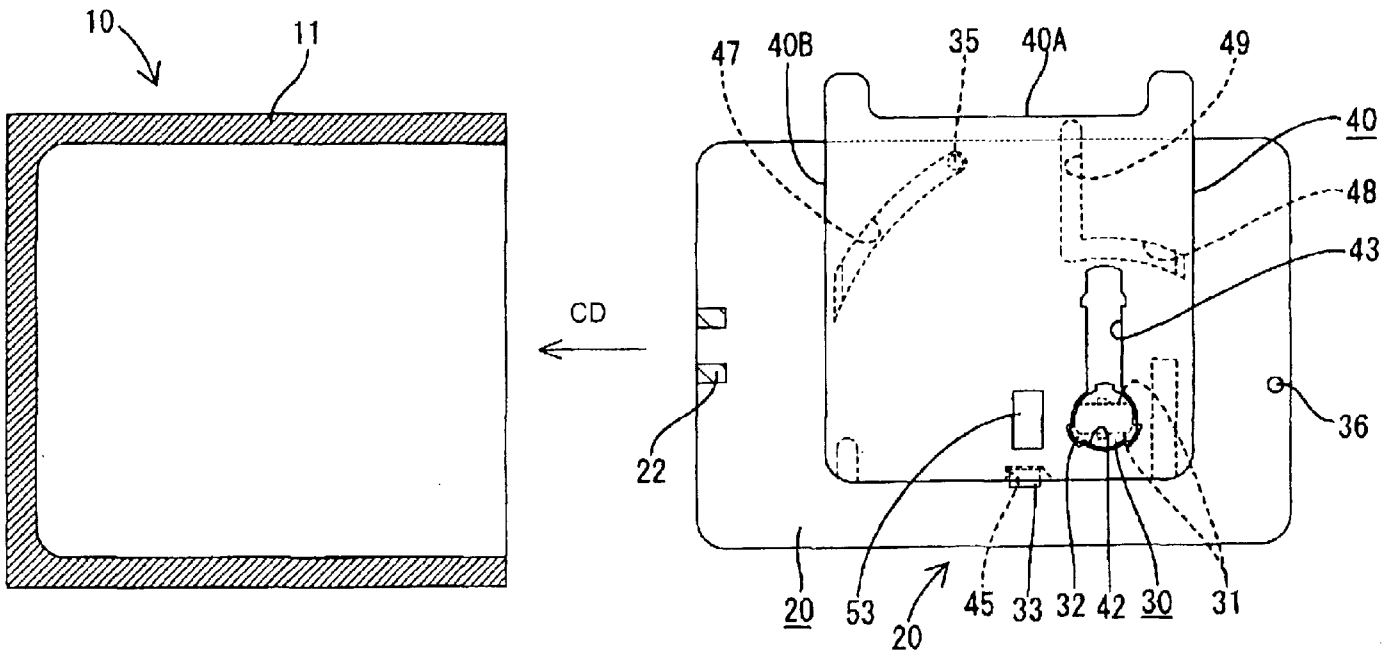
FIG. 1 is a plan view partly in section showing connected male and female housings according to one embodiment of the invention.
Figure 10:
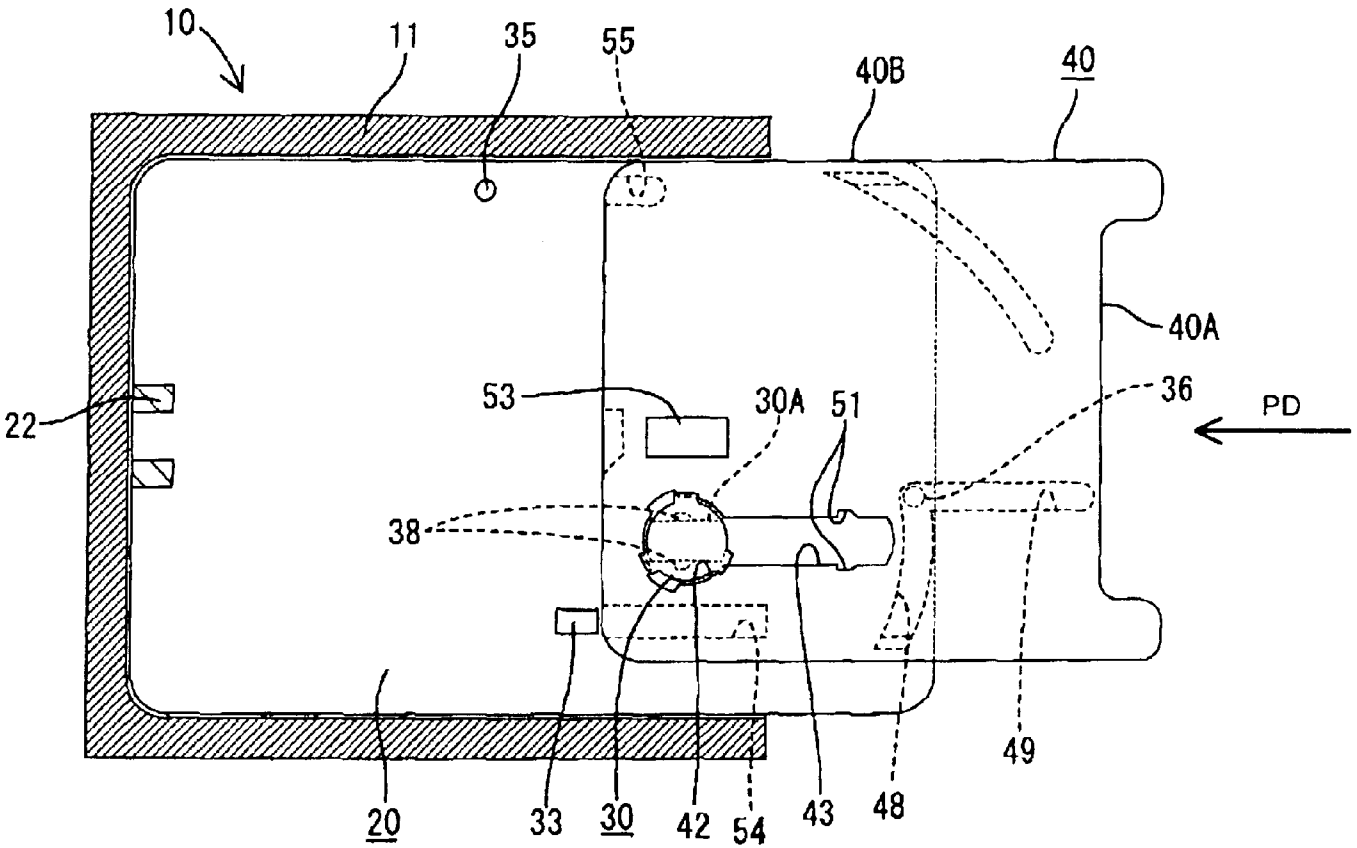
FIG. 10 is a plan view partly in section showing the two housings properly connected and the detector rotated to a retracted position.

The detector 40 is mounted initially at a mount position shown in FIG. 1, and is rotatable from the mount position to a retracted position shown in FIG. 10. Additionally, the detector 40 is movable forward substantially along the connecting direction CD from the retracted position to an advanced position shown in FIG. 12.

A supporting shaft 30 projects from the upper surface of the female housing 20 at a position displaced from the center toward the lower-right corner of FIG. 1 and towards the back as seen in the connecting direction CD. The supporting shaft 30 has a height slightly larger than the thickness of the detector 40. Two substantially parallel surfaces 31 are formed on the outer periphery of a portion 30A at the bottom side of the supporting shaft 30 and extend substantially along a connecting direction CD. The parallel surfaces 31 substantially correspond to the thickness of the detector 40. Three protrusions 32 are provided at angularly spaced substantially even intervals on the outer circumferential surface of a remaining upper end 30B of the supporting shaft 30.

A shaft hole 42 is formed at a position on the detector 40 corresponding to the position of the supporting shaft 30. The shaft hole 42 is engageable with the supporting shaft 30. A slide groove 43 extends from a position on the inner circumferential surface of the shaft hole 42 in a direction substantially normal to the operable side 40A. The slide groove 43 has a width substantially equal to a dimension between the two parallel surfaces 31 of the supporting shaft 30.

Recesses 44 are formed at positions on the inner circumferential surface of the shaft hole 42 at a side opposite from the slide groove 43 for receiving the corresponding protrusions 32 of the supporting shaft 30.

A rotation-stopping projection 33 is provided on the upper surface of the female housing 20 slightly behind the longitudinal center and displaced toward the right edge (bottom edge of FIG. 1) when viewed from the front. A holding recess 45 is formed at a substantially middle of the side of the lower surface of the detector 40 opposite from the operable side 40A for receiving the rotation-stopping projection 33. The front surface of this holding recess 45 with respect to clockwise direction in FIG. 1 is formed into a perpendicular surface, whereas the rear surface thereof is slanted to form a semi-locking construction.

A first pin 35 stands substantially in the longitudinal center of the upper surface of the female housing 20 at the right end (upper end of FIG. 1) when viewed from front and a second pin 36 stands at the rear end slightly displaced toward the right end (lower end in FIG. 1) from the widthwise center. First and second guiding grooves 47, 48 are formed in the lower surface of the detector 40 for slidably receiving the first and second pins 35, 36.

The first guiding groove 47 has an arcuate shape with a center at the shaft hole 42. The first guiding groove 47 extends from the operable side 40A to the left side of FIG. 1 (hereinafter, pressable side 40B). The end surface of the first guiding groove 47 toward the pressable side 40B is slanted.

The second guiding groove 48 also has an arcuate shape and has a center substantially at the shaft hole 42. The second guiding groove 48 extends from the right side of FIG. 1 to a position before the leading end of the slide groove 43 and is slightly at the left side of the slide groove 43. The starting end surface of the second guiding groove 48 is slanted.

An escaping groove 49 extends from the end of the second guiding groove 48 toward the operable side 40A for receiving the second pin 36. The escaping groove 49 is normal to the operable side 40A, parallel to the slide groove 43 and parallel to the connecting direction CD when the detector 40 is in the advanced position (FIG. 12) or the retracted position (FIG. 10).

Figure 2:
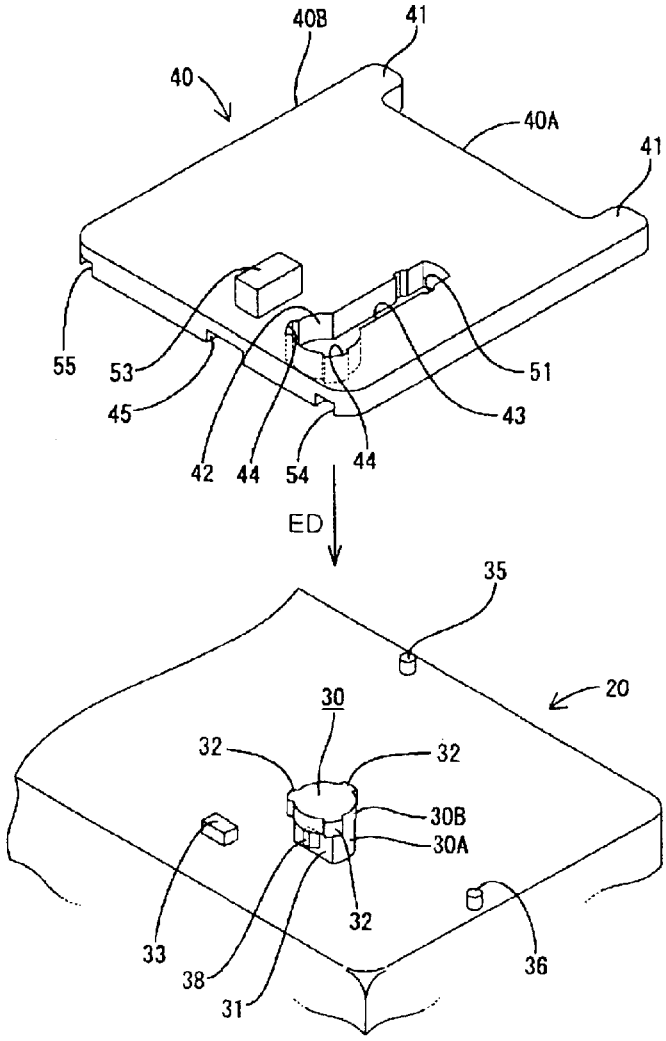
FIG. 2 is an exploded perspective view showing a mounting construction for a detector.
Figure 3:
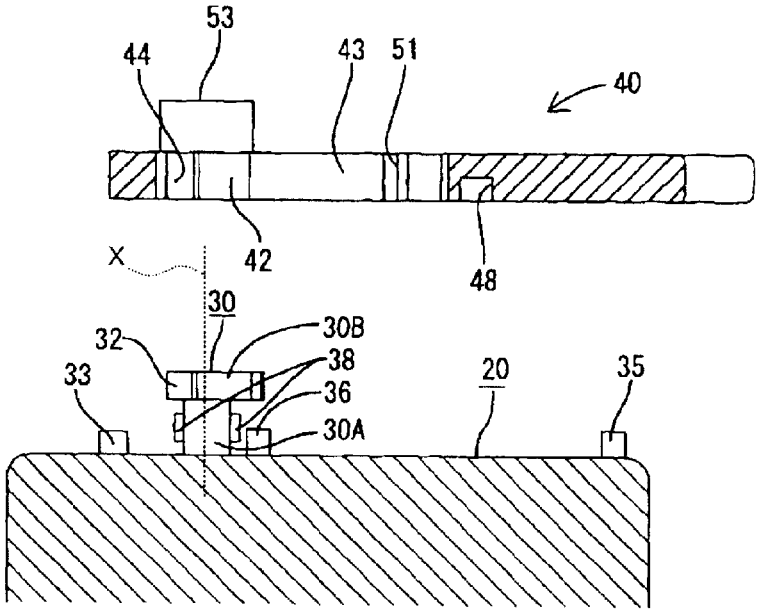
FIG. 3 is an exploded vertical section of the mounting construction.
Figure 4:
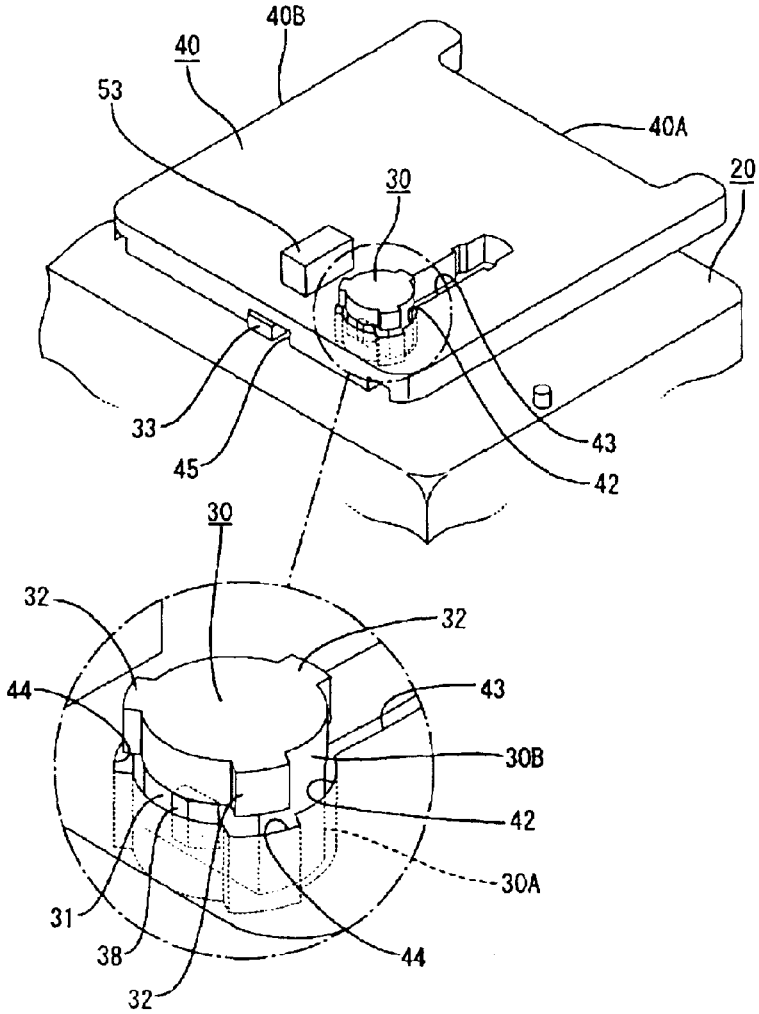
FIG. 4 is a partial perspective view showing a state where the detector is mounted.

The detector 40 is oriented such that the operable side 40A faces left (up in FIG. 1) when viewed from the front, and the shaft hole 42 is engaged with the supporting shaft 30 in an engaging direction ED shown by an arrow in FIG. 2 with the two recesses 44 and the slide groove 43 aligned with the protrusions 32. As shown in FIG. 4, the shaft hole 42 is rotatably engaged with the bottom end 30A of the supporting shaft 30 after passing the protrusions 32. At this time, the rotation-stopping projection 33 is fit into the holding recess 45 and the first pin 35 is fit into the starting end of the first guiding groove 47. Thus, the detector 40 is prevented from rotation. This position is referred to as the mount position of the detector 40.

At this mount position, the operable side 40A of the detector 40 projects from the left side edge (upper edge in FIG. 1) of the upper surface of the female housing 20 when viewed from the front.

As described above, the operable side 40A of the detector 40 projects from the left side edge of the upper surface of the female housing 20. Thus, the opening edge of the receptacle 11 presses the pressable side 40B of the detector 40 as the male and female housings 10, 20 are connected. Accordingly, the detector 40 is rotated about the supporting shaft 30 in a rotation direction RD (clockwise direction of FIG. 1) about a rotation axis X arranged substantially normal to the connecting direction CD.

Figure 5:
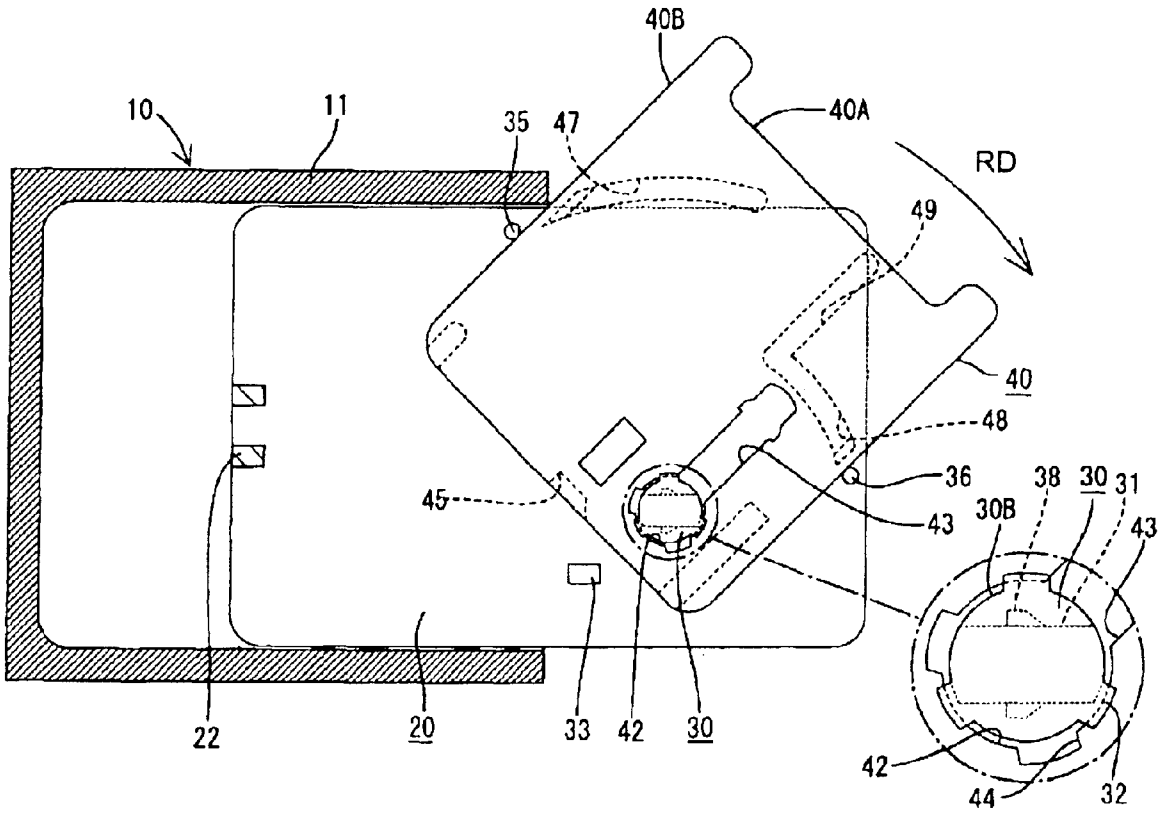
FIG. 5 is a plan view partly in section showing a state where the detector is rotated by 45° during the connection of the housings.

When the detector 40 is rotated by a specified first angle, e.g. by about 45°, the first pin 35 comes out from the terminus end of the first guiding groove 47 and is brought substantially into contact with the pressable side 40B. Additionally, the second pin 36 is brought substantially into contact with a side of the detector 40 opposite from the pressable side 40B to substantially face the starting end of the second guiding groove 48 at a position immediately before it as shown in FIG. 5. The second pin 36 is introduced into the second guiding groove 48 by the further rotation of the detector 40.

The detector 40 is displaced from the mount position by about 90°, as shown in FIG. 10, when the male and female housings 10, 20 are connected properly. This position is referred to as the retracted position. In the retracted position, the slide groove 43 and the escape groove 49 extend straight back along the connecting direction CD. The bottom portion 30A of the supporting shaft 30 formed with the two substantially parallel surfaces 31 is aligned with and faces the entrance of the slide groove 43, and the second pin 36 substantially faces the entrance of the escaping groove 49. Accordingly the detector 40 is movable along a pushing direction PD substantially parallel to the connecting direction CD toward the advanced position shown in FIG. 12.

Figure 12:
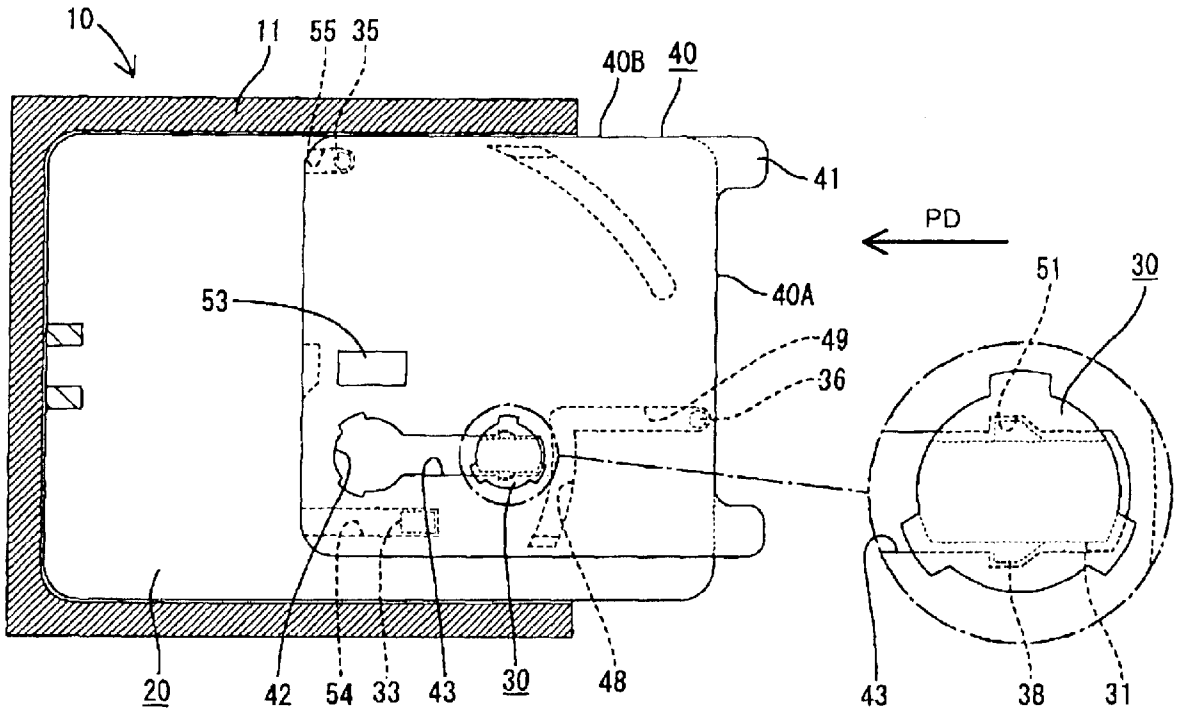
FIG. 12 is a plan view partly in section showing a state where the detector is rotated to an advanced position.

A locking protuberance 38 is formed on each of the two substantially parallel surfaces 31 at the bottom of the supporting shaft 30, and locking holes 51 are formed in the opposite side surfaces at the back end of the slide groove 43 for receiving the locking protuberances 38 when the detector 40 reaches the advanced position (FIG. 12).

A restricting base 53 projects at one side of the shaft hole 42 on the upper surface of the detector 40 and can slip under the engageable portion 24 of the lock arm 22 and between the engageable portion 24 and the female housing 20 in the natural state thereof when the detector 40 reaches the advanced position (FIG. 12).

Escaping grooves 54, 55 are formed in the lower surface of the detector 40 at the opposite ends of the side opposite from the operable side 40A in a direction substantially parallel to the pushing direction PD and receive the rotation-stopping projection 33 and the first pin 35 for an escaping purpose.

The detector 40 is mounted at the mount position shown in FIG. 1 in the aforementioned manner. The detector 40 is substantially normal to the connecting direction CD of the two housings 10, 20 and the operable side 40A projects from the left edge of the upper surface of the female housing 20 when viewed from front. In this state, the female housing 20 is fit into the receptacle 11 of the mating male housing 10 in the connecting direction CD as indicated by an arrow of FIG. 1.

During the connection, the opening edge of the receptacle 11 of the male housing 10 contacts the pressable side 40B of the detector 40 projecting from the female housing 20. Thus, the detector 40 is rotated about the supporting shaft 30 in the rotation direction RD (clockwise in FIG. 1) while the rotation-stopping projection 33 is caused to come out of the holding recess 45.

During this time, the first pin 35 slides along the first guiding groove 47, and comes out from the end of the first guiding groove 47 and the second pin 36 faces the starting end of the second guiding groove 48 immediately before it when the detector 40 is rotated by about 45°, as shown in FIG. 5. At this time, the detector 40 is prevented from disengagement by the engagement of the protrusions 32 of the upper end 30B of the supporting shaft 30 with the opening edge of the shaft hole 42.

Figure 6:
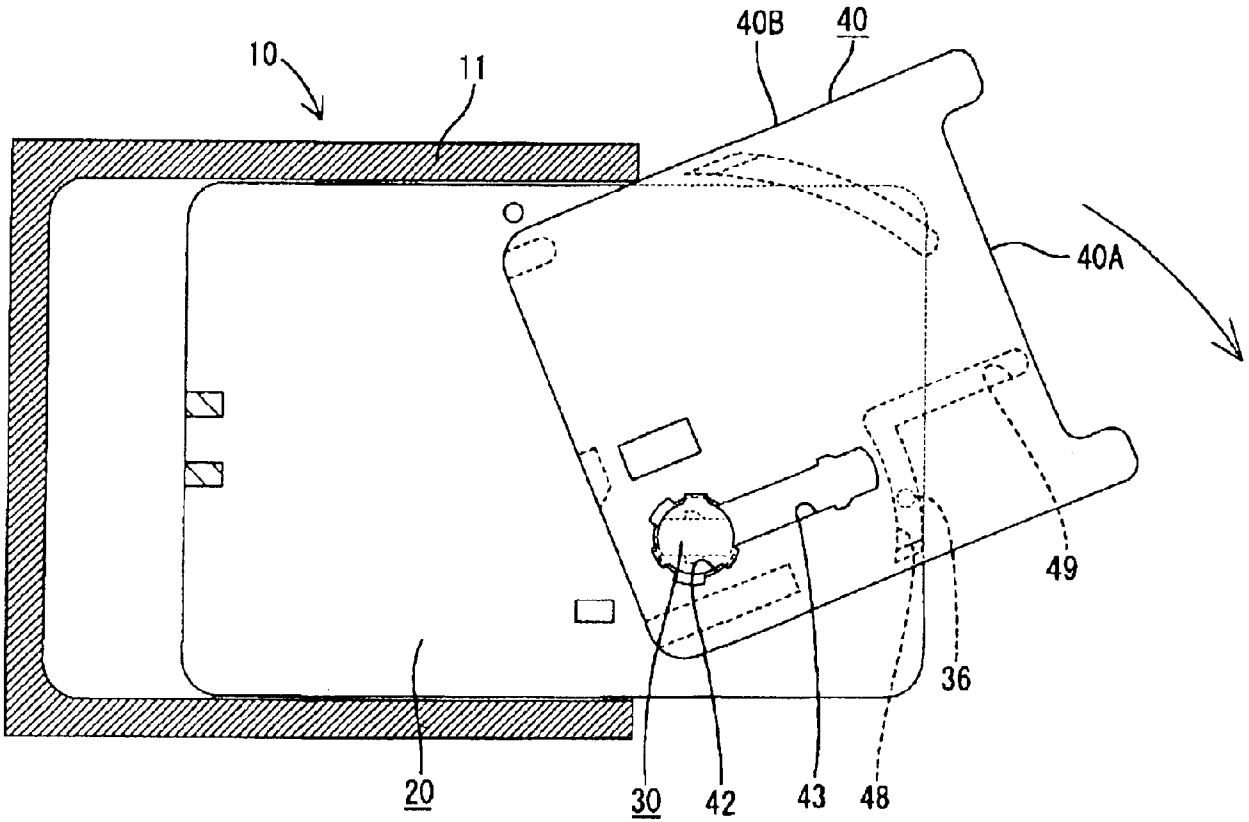
FIG. 6 is a plan view partly in section showing a further progressed state of the connection.

The detector 40 is rotated further in the direction RD as the connection continues and the second pin 36 enters and slides along the second guiding groove 48 as shown in FIG. 6. At an intermediate stage of the connection, the engageable portion 24 of the lock arm 22 faces the locking projection 13 on the ceiling surface of the receptacle 11 of the male housing 10, as shown in FIG. 7.

Figure 8:
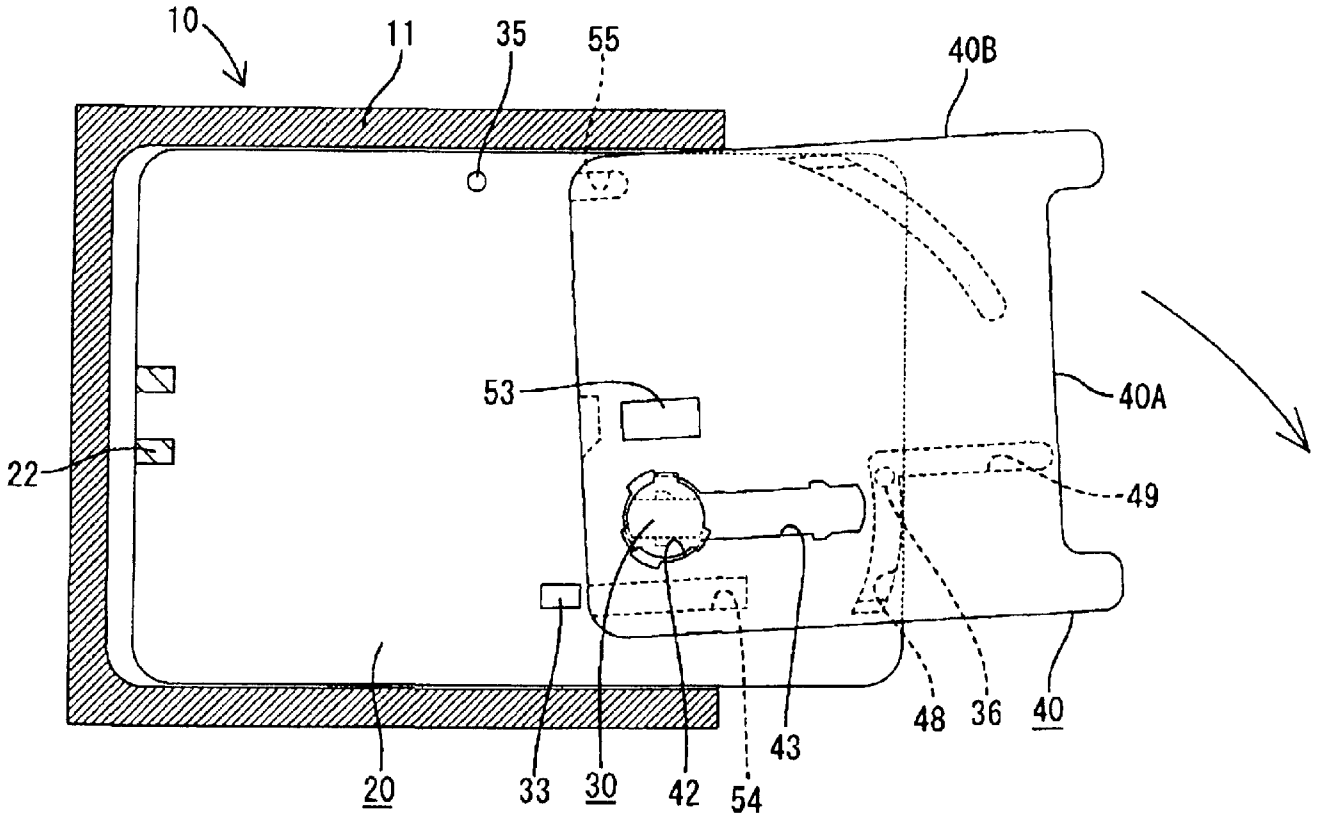
FIG. 8 is a plan view partly in section showing a state immediately before the two housings are properly connected.
Figure 9:
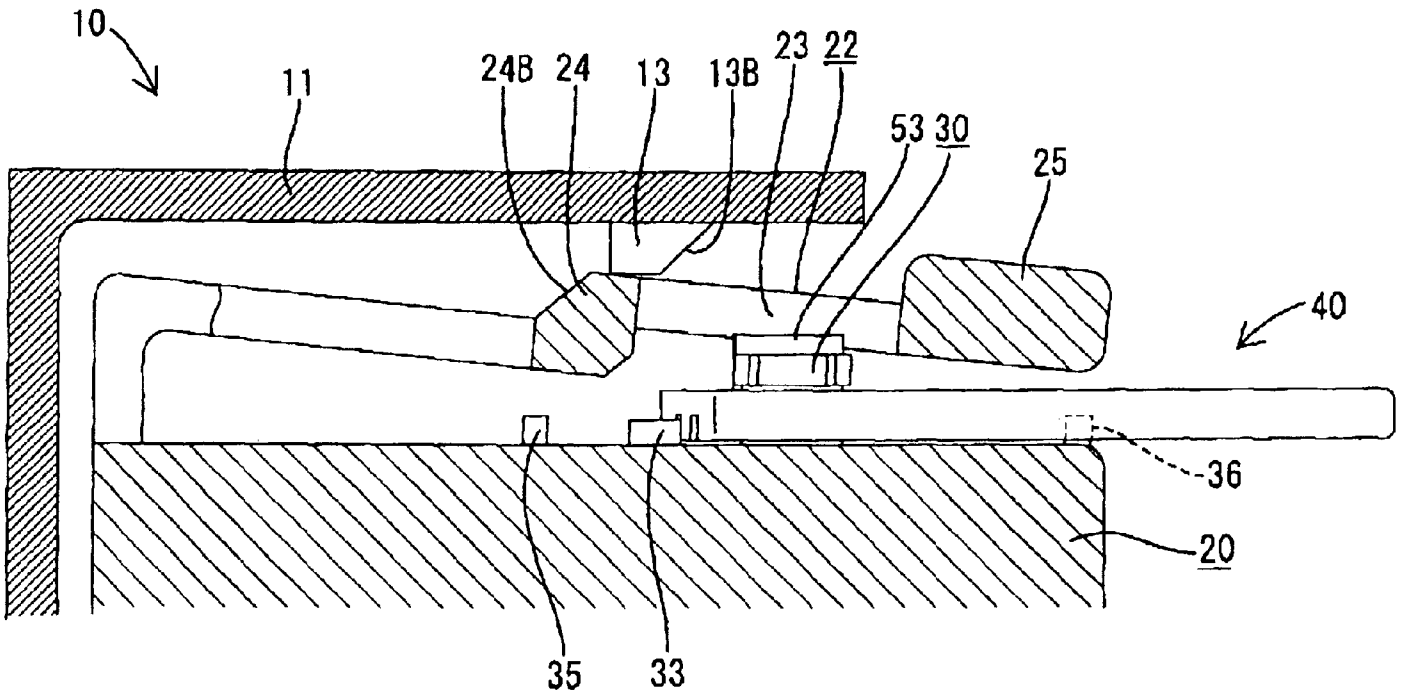
FIG. 9 is a vertical section showing the state of FIG. 8.

As the connection further proceeds, the detector 40 is rotated further in the rotation direction RD toward the retracted position as shown in FIG. 8 and is pushed in while the engageable portion 24 moves onto the locking projection 13 and the lock arm 22 is inclined resiliently, as shown in FIG. 9.

Considerable resistance is created as the connecting operation of the housings 10, 20 approaches a final stage, since the male and female terminal fittings are connected deeper. Thus, the connecting operation may be stopped due to a misunderstanding that the housings 10, 20 have already been connected properly. In such a case, the detector 40 has not yet reached the retracted position and takes an improper oblique posture. Thus, the partial connection can be confirmed by seeing such a posture. As shown in FIG. 8, it may be difficult to detect the connected state based on the posture of the detector 40 immediately before the two housings 10, 20 reach the properly connected state. If the detector 40 is pushed forward in such a case, the rear surface of the second guiding groove 48 contacts the second pin 36 that has not has exited the second guiding groove 48, and the detector 40 is prevented from being pushed in. As a result, partial connection on the two housings 10, 20 can be confirmed.

Figure 11:
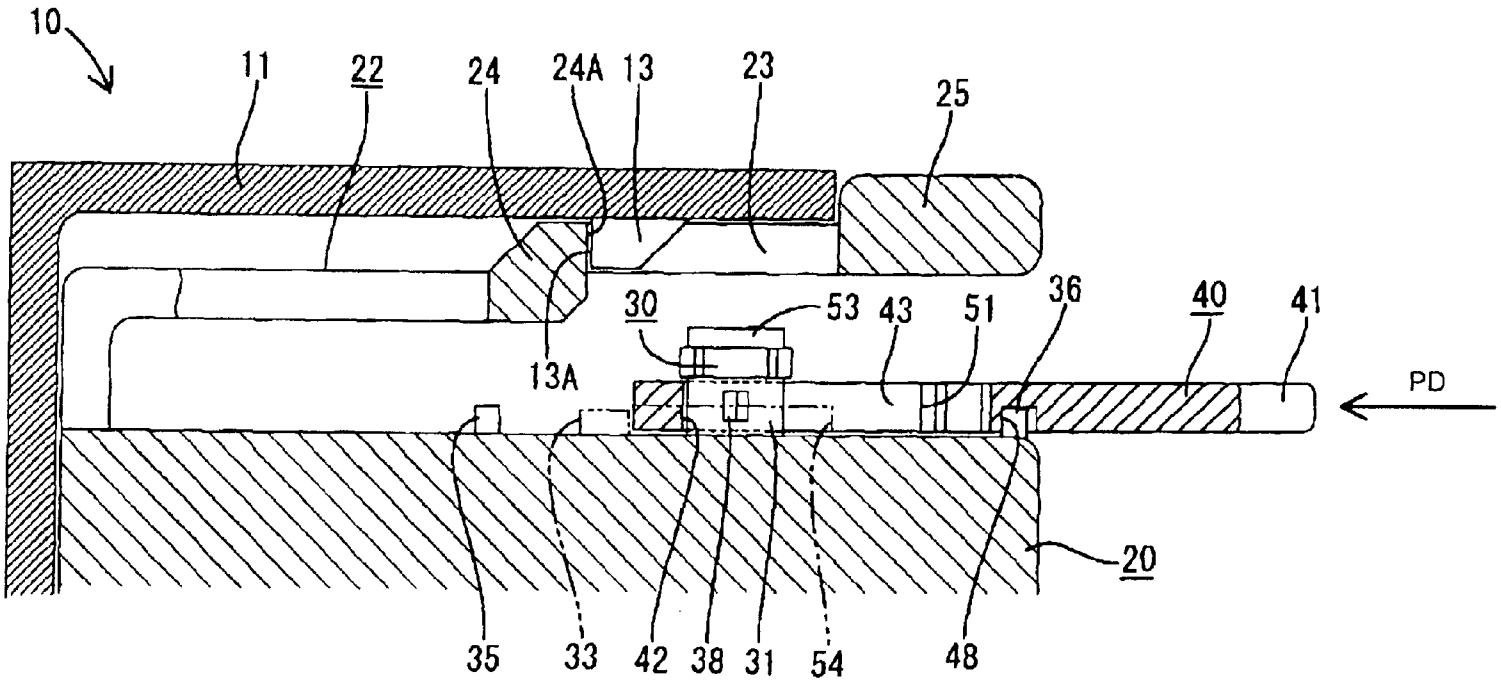
FIG. 11 is a vertical section showing the state of FIG. 10.

The engageable portion 24 of the lock arm 22 passes the locking projection 13 when the female housing 20 is pushed to the proper position. Therefore, the lock arm 22 returns to its initial position and the engageable portion 24 engages the locking projection 13 from behind, as shown in FIG. 11. As a result, the housings 10, 20 are locked in their properly connected state. Simultaneously, the detector 40 has been rotated from the mount position to the retracted position and takes a posture substantially parallel with the connecting direction CD of the housings 10, 20. Thus, the operable side 40A faces backward as shown in FIG. 10. The proper connection of the two housings 10, 20 can be confirmed by seeing this posture of the detector 40.

The detector 40 is pushed in the pushing direction PD for a reconfirmation. If the detector 40 is at the retracted position (FIG. 10), the bottom 30A of the supporting shaft 30 formed with the two substantially parallel surfaces 31 faces the entrance of the slide groove 43 and the second pin 36 faces the entrance of the escape groove 49. Thus, the bottom 30A of the supporting shaft 30 and the second pin 36 slide along the slide groove 43 and the escape groove 49, respectively, and the detector 40 is pushed straight in the pushing direction PD while the pressable side 40B is guided along the inner surface of the receptacle 11. At an intermediate stage, the rotation-stopping projection 33 and the first pin 35 fit into the corresponding escape grooves 54, 55.

The detector 40 is pushed in the pushing direction PD until the bottom 30A of the supporting shaft 30 contacts the back end of the slide groove 43, and the locking protuberances 38 on the parallel surfaces 31 fit into the locking holes 51 as shown in FIG. 12. Thus, the detector 40 is at the advanced position and is prevented from making a return movement. Proper connection of the housings 10, 20 is detected again because the detector 40 can be pushed in the pushing direction PD to this advanced position (FIG. 12).

Figure 13:
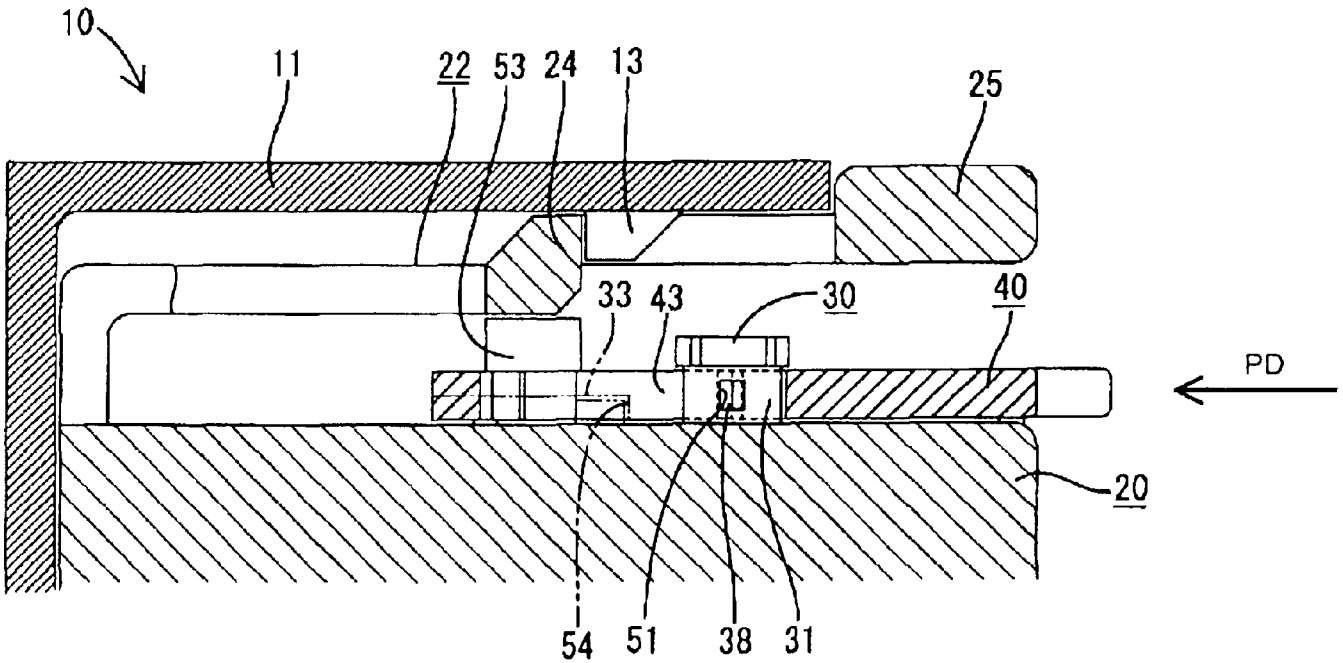
FIG. 13 is a vertical section showing the state of FIG. 12.

The restricting base 53 projects from the detector 40 right below the engageable portion 24 of the lock arm 22, as shown in FIG. 13, when the detector 40 is pushed to the advanced position. Thus, the restricting base 53 prevents the lock arm 22 from being inclined, and therefore prevents an inadvertent unlocking.

As described above, proper connection of the housings 10, 20 can be detected in two ways. First, the detector 40 can be rotated in the rotating direction RD from the mount position to the retracted position where the detector 40 takes a posture substantially parallel with the connecting direction CD of the housings 10, 20. Second, the detector 40 can be pushed in the pushing direction PD from the retracted position to the advanced position. Thus, connection detection is improved remarkably. Further, since the single detector 40 makes two kinds of detections, the construction can be simplified.

The receptacle 11 of the male housing 10 is used as it is to rotate the detector 40 to the retracted position. Thus, the rotation of the detector 40 can be achieved without changing the shape of the male housing 10.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

An engaging portion may be provided separately from the receptacle to rotate the detector from the mount position to the retracted position.

Depending on the shapes of the housings and other factors, the male housing may be provided with the lock arm and the detector.

The invention is similarly applicable to wire-to-wire connectors.

What is claimed is:

1. A connector, comprising:

a housing (20) connectable with a mating housing (10);

a resiliently displaceable lock arm (22) on the housing (20) to lock the housing (20) and the mating housing (10) in a properly connected state; and a detector (40) engageable with an engaging portion (11) of the mating housing (10) for generating rotation of the detector (40) from a mount position at an intermediate stage of connection of the two housings (20, 10) to a retracted position when the two housings (20, 10) are connected properly, the detector (40) further being movable along a moving direction (PD) substantially adjacent the housing (20) from the retracted position (FIG. 10) where resilient displacement of the lock arm (22) is permitted to an advanced position (FIG. 12) where resilient displacement of the lock arm (22) is prevented to detect whether the housings (20, 10) are connected properly.

2. A connector assembly comprising the connector of claim 1 and a mating connector connectable therewith.

3. The connector of claim 1, wherein the housing (20) comprises at least one restricting means (36; 48) for preventing the detector (40) from being pushed in the moving direction (PD) until reaching the retracted position.

4. The connector of claim 3, wherein the housing (20) is fittable into a receptacle (11) in the mating housing (10) and an opening edge of the receptacle (11) defining the engageable portion.

5. The connector of claim 3, wherein the detector (40) comprises a restricting portion (53) located in a deformation space for the lock arm (22), when the detector (40) is in the advanced position to prevent displacement of the lock arm (22).

6. The connector of claim 3, wherein rotation preventing means (54, 33; 55, 35) are provided for preventing a rotation of the detector (40) when the detector (40) is moved between the retracted and advanced positions.

7. The connector of claim 3, wherein locking means (38; 51) are provided for locking the detector (40) in the advanced position.

8. A method for connecting a connector with a mating connector, comprising the following steps:

connecting a housing (20) of the connector with a mating housing (10) of the mating connector while simultaneously engaging a detector (40) on the housing (20) with an engaging portion (11) of the mating housing (10) for rotating the detector (40) from a mount position at an intermediate stage of connection of the two housings (20, 10) to a retracted position when the housings (20, 10) are in a properly connected state;

engaging a lock arm (22) of the housing (20) with the mating housing (10) to lock the housings (20, 10) in the properly connected state; and moving the detector (40) along a pushing direction (PD) from the retracted position (FIG. 10) to an advanced position (FIG. 12) between the housing (20) and the lock arm (22) for detecting whether the two housings (20, 10) are in the properly connected state.

9. The method of claim 8, further comprising preventing the detector (40) from being pushed in the pushing direction (PD) until the detector (40) is rotated to the retracted position.

10. The method of claim 8, wherein the step of connecting the housing (20) with a mating housing (10) comprises fitting the housing (20) into a receptacle (11) in the mating housing (10) and wherein the step of engaging the detector (40) with an engaging portion (11) of the mating housing (10) comprises engaging the detector (40) with an opening edge of the receptacle (11).

11. The method of claim 8, further comprising preventing rotation of the detector (40) by rotation preventing means (54, 33; 55, 35) when the detector (40) is moved between the retracted position and the advanced position.

12. The method of claim 8, further comprising locking the detector (40) in the advanced position.

* * * * *